US007351125B2

(12) United States Patent
Ide et al.

(10) Patent No.: US 7,351,125 B2
(45) Date of Patent: Apr. 1, 2008

(54) OUTBOARD ENGINE SYSTEM

(75) Inventors: Shinichi Ide, Saitama (JP); Kentaro Furuya, Saitama (JP); Teruhiko Otsuki, Saitama (JP); Shigeo Terada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/282,953

(22) Filed: Nov. 21, 2005

(65) Prior Publication Data

US 2006/0135007 A1 Jun. 22, 2006

(30) Foreign Application Priority Data

Nov. 22, 2004 (JP) ..... 2004-337819
Nov. 22, 2004 (JP) ..... 2004-337820

(51) Int. Cl.
*B63H 5/20* (2006.01)
*B63H 5/125* (2006.01)
*B63H 20/08* (2006.01)

(52) U.S. Cl. ..... 440/53; 440/61 T; 440/61 F

(58) Field of Classification Search ..... 440/53–57, 440/61, 61 R, 61 S, 61 A, 61 B, 61 C, 61 T, 440/61 D, 61 E, 61 F, 61 G, 61 H, 61 J
See application file for complete search history.

(56) References Cited

U.S. PATENT DOCUMENTS 3,912,343 A * 10/1975 Paton et al. ..... 384/423
4,720,278 A * 1/1988 Taguchi et al. ..... 440/61 R
5,597,333 A * 1/1997 Soda ..... 440/61 R
6,071,157 A * 6/2000 Yoshino et al. ..... 440/61 R
6,325,686 B1 * 12/2001 Funami ..... 440/61 R

FOREIGN PATENT DOCUMENTS

JP 61-132199 8/1986
JP 62-100297 6/1987
JP 8-91298 4/1996

* cited by examiner

*Primary Examiner*—Lars A. Olson
*Assistant Examiner*—Daniel V. Venne
(74) *Attorney, Agent, or Firm*—Arent Fox LLP

(57) ABSTRACT

A thrust receiver abuts against an expandable and contractable trim rod to adjust a trim angle of a body of an outboard engine system. The thrust receiver includes a shaft portion rotatable about an axis generally parallel to an axis of the trim rod, and a pressure-receiving portion provided on the shaft portion to abut against a tip end of the trim rod. An abutment point between the trim rod and the pressure-receiving portion is displaced by a distance from an axis of the shaft portion in a lateral direction of the system body. Because the pressure-receiving portion of the thrust receiver rotates about the axis of the shaft portion accompanying the expansion and contraction of the trim rod, a twisting generated at the abutment point can be minimized to suppress generation of an abnormal sound. Moreover, the structure can be simplified to contribute to a reduction in cost, as compared with a system in which a ball is disposed at an abutment point.

3 Claims, 14 Drawing Sheets

OUTBOARD ENGINE SYSTEM

RELATED APPLICATION DATA

The present invention is based upon Japanese priority application Nos. 2004-337819 and 2004-337820, which are hereby incorporated in their entirety herein by reference.

BACKGROUND OF THE INVENTION

1. Field of the Invention

The present invention relates to an outboard engine system in which a trim angle of a system body can be adjusted with respect to a hull by a trim device and a thrust receiver which are mounted on one and the other of the system body and a mounting device, respectively. The present invention also relates to an outboard engine system comprising a system body having a propeller shaft, and a trim device having an expandable and contractable trim rod which abuts against a thrust receiver to adjust a trim angle of the system body with respect to a hull.

2. Description of the Related Art

Such an outboard engine system is known from Japanese Patent Application Laid-open No. 8-91298 and Japanese Utility Model Application Laid-open Nos. 62-100297 and 61-132199.

In the outboard engine system described in each of Japanese Patent Application Laid-open No. 8-91298 and Japanese Utility Model Application Laid-open No. 62-100297, a tip end face of an expandable and contractable trim rod of a trim cylinder mounted on a stern bracket is in abutment against a rotatable ball of a thrust receiver mounted on a swivel case; and generation of an abnormal sound due to a twisting is prevented by rolling of the ball on the tip end face of the trim rod, when the trim rod is expanded or contracted to adjust a trim angle of a system body.

In the outboard engine system described in Japanese Utility Model Application Laid-open No. 61-132199, a ball rotatably mounted at a tip end of a trim rod of a trim cylinder is in abutment against a pressure-receiving surface of a thrust receiver; and generation of an abnormal sound due to a twisting is prevented by rolling of the ball on the pressure-receiving surface of the thrust receiver, when the trim rod is expanded or contracted to adjust a trim angle of a system body.

However, all the systems in the above-described documents have a problem of a high manufacturing cost, because they need the ball for bringing the trim rod and the thrust receiver into rolling contact with each other in order to adjust the trim angle.

In all the system in the above-described documents, although the ball is rotatably supported on a holder, a special means for smoothly rotating the ball is not provided. Fat such as grease is generally applied to sliding surfaces between the ball and the holder, but in a severe environment exposed to seawater as in the case of an outboard engine system, there is a possibility that the fat flows out in a short period to lose a lubricating effect.

SUMMARY OF THE INVENTION

Accordingly, it is a first object of the present invention to provide a simple structure for reducing an abnormal sound generated when adjusting the trim angle of a body of an outboard engine system by a trim device and a thrust receiver.

It is a second object of the present invention to reliably rubricate portions moved relative to each other with fat when adjusting the trim angle of a body of an outboard engine system by bringing an expandable and contractable trim rod into abutment against a thrust receiver.

In order to achieve the first object, according to a first feature of the present invention, there is provided an outboard engine system comprising: a system body having a propeller shaft; a mounting device for mounting the system body to a hull for tilting movement; a trim device having an expandable and contractable trim rod mounted on one of the system body and the mounting device; and a thrust receiver mounted on the other of the system body and the mounting device to support a thrust force of the system body transmitted through the trim rod of the trim device, wherein the thrust receiver includes: a shaft portion supported for rotation about an axis generally parallel to an axis of the trim rod; and a pressure-receiving portion provided at one end of the shaft portion to abut against a tip end of the trim rod; and wherein an abutment point between the tip end of the trim rod and the pressure-receiving portion of the thrust receiver is displaced from the axis of the shaft portion in a lateral direction of the system body.

With the above arrangement, the thrust receiver abuts against the expandable and contractable trim rod to adjust the trim angle of the system body, and includes the shaft portion rotatable about the axis generally parallel to the axis of the trim rod, and the pressure-receiving portion provided on the shaft portion to abut against the tip end of the trim rod; and the abutment point between the trim rod and the pressure-receiving portion is displaced from the axis of the shaft portion in a lateral direction of the system body. Therefore, a twisting generated at the abutment point can be minimized to suppress the generation of an abnormal sound by the rotation of the pressure-receiving portion of the thrust receiver about the axis accompanying the expansion or contraction of the trim rod. Moreover, as compared with a conventional system in which a ball is disposed at the abutment point, the structure can be simplified to contribute to a reduction in cost, and further it is not necessary to roll a ball at the tip end of the trim rod, and hence the diameter of the trim rod can be reduced.

According to a second feature of the present invention, in addition to the first feature, the shaft portion of the thrust receiver also serves as a mounting portion.

With the above arrangement, the shaft portion of the thrust receiver also serves as the mounting portion, and hence the thrust receiver can be mounted utilizing the shaft portion without provision of a special mounting portion, leading to a simplified structure.

According to a third feature of the present invention, in addition to the first or second feature, the system further comprises a fat-supplying means for supplying fat to a surface of the pressure-receiving portion of the thrust receiver.

With the above arrangement, the fat is supplied from the fat supplying means to the surface of the pressure-receiving portion of the thrust receiver, and hence the abutment point between the pressure-receiving portion and the trim rod can be lubricated to further effectively prevent an abnormal sound generated during changing of the trim angle.

In order to achieve the second object, according to a fourth feature of the present invention, there is provided an outboard engine system comprising: a system body having a propeller shaft; and a trim device having an expandable and contractable trim rod which abuts against a thrust-receiving section to adjust a trim angle of the system body with respect to a hull, wherein the thrust-receiving section is mounted for movement relative to at least one of the trim rod and the system body, and the system further includes a fat-retaining portion for supplying fat to portions moved relative to each other.

With the above arrangement, when the expandable and contractable trim rod of the trim device is put into abutment against the thrust-receiving section in order to adjust the trim angle of the system body, the thrust-receiving section is moved relative to at least one of the trim rod and the system body. However, a sufficient amount of fat can be continuously supplied to the relatively-moved portions to prevent the generation of an abnormal sound over a long period, because the fat-retaining portion for supplying the fat to the relatively-moved portions.

According to a fifth feature of the present invention, in addition to the fourth feature, the thrust-receiving section has, on its surface abutting against the trim rod, a contact portion and a non-contact portion with the trim rod so that fat is supplied from the fat-retaining portion through the non-contact portion to the contact portion.

With the above arrangement, the thrust-receiving section has the contact portion and the non-contact portion on its surface abutting against the trim rod, and the fat is supplied from the fat-retaining portion through the non-contact portion to the contact portion. Therefore, it is possible to prevent the trim rod from abutting against the non-contact portion which has grooves or steps for guiding fat and obstructing the smooth abutment.

According to a sixth feature of the present invention, in addition to the fourth or fifth feature, the thrust-receiving section comprises a rolling member rotatably retained on a holding member so that fat is supplied from the fat-retaining portion to a non-contact portion between the rolling member and the holding member.

With the above arrangement, the thrust-receiving section rotatably retains the rolling member on the retaining member, and the fat is supplied from the fat-retaining portion to the non-contact portion between the rolling member and the retaining member. Therefore, the non-contact portion between the rolling member and the retaining member can be effectively lubricated over a long period by the fat accumulated in the non-contact portion.

In order to achieve the second object, according to a seventh feature of the present invention, there is provided an outboard engine system comprising: a system body having a propeller shaft; and a trim device having an expandable and contractable trim rod which abuts against a thrust-receiving section to adjust the trim angle of the system body with respect to a hull, wherein a sliding portion is formed at a portion of the thrust-receiving section, and the sliding portion has a fat charging bore for charging fat from outside to the sliding portion.

With the above arrangement, when the expandable and contractable trim rod of the trim device is put into abutment against the thrust-receiving section in order to adjust the trim angle of the system body, the thrust-receiving section is slid on the sliding portion. However, the fat can be easily supplied to the sliding portion without disassembling the thrust-receiving section thereby preventing the generation of an abnormal sound, because the sliding portion has the fat charging bore for charging the fat from outside to the sliding portion.

In the first to third features, a stern bracket 23 in an embodiment corresponds to the mounting device of the present invention; a trim cylinder 30 in the embodiment corresponds to the trim device of the present invention; a propelling unit U in the embodiment corresponds to the system body of the present invention; a transom in the embodiment corresponds to the hull of the present invention; and an oil groove g3 in the embodiment corresponds to the fat supplying means of the present invention.

In the fourth to seventh features, a trim cylinder 30 in an embodiment corresponds to the trim device of the present invention; an oil reservoir 31*c*, oil passages 32*c*, 32*d*, 44*b*, 44*c* and oil grooves g1 and g2 in the embodiment correspond to the fat-retaining portion of the present invention; a grease charging bore 31*d* in the embodiment corresponds to the fat charging bore of the present invention; a thrust receiver 32 corresponds to the thrust-receiving section of the present invention; grease 39 in the embodiment corresponds to the fat of the present invention; a ball holder 44 in the embodiment corresponds to the retaining member of the present invention; a ball 45 in the embodiment corresponds to the rolling member of the present invention; a space 46 and an oil groove g3 in the embodiment correspond to the non-contact portion of the present invention; a propelling unit U in the embodiment corresponds to the system body of the present invention; and a transom T in the embodiment corresponds to the hull of the present invention.

A mounting device of an outboard engine system O is generally comprises a stern bracket 23 and a swivel case 22, but in this specification, it is defined that the mounting device comprises a stern bracket 23, and a swivel case 22 is a portion of a propelling unit U.

The above and other objects, features and advantages of the invention will become apparent from the following detailed description of the preferred embodiment taken in conjunction with the accompanying drawings.

BRIEF DESCRIPTION OF THE DRAWINGS

FIGS. 1 to 12 show a first embodiment of the present invention, wherein

FIG. 1 is a side view of the entire arrangement of an outboard engine system;

FIG. 2 is an enlarged sectional view of essential portions of FIG. 1;

FIG. 3 is a view taken along a line 3-3 in FIG. 2;

FIG. 4 is an enlarged view of Area 4 in FIG. 2;

FIG. 5 is a sectional view taken along a line 5-5 in FIG. 4;

FIG. 6 is an enlarged view of Area 6 in FIG. 5;

FIG. 7 is a front view of a second bush (a view taken from a direction of an arrow 7 in FIG. 8);

FIG. 8 is a sectional view taken along a line 8-8 in FIG. 7;

FIG. 9 is a view taken from a direction of an arrow 9 in FIG. 8;

FIG. 10 is a view for explaining the operation during tilting-up;

FIG. 11 is a view taken from a direction of an arrow 11 in FIG. 10; and FIG. 12 is a view for explaining the operation during adjustment of a trim angle.

FIGS. 14 and 15 show a third embodiment of the present invention, wherein FIG. 14 is a view similar to FIG. 6; and FIG. 15 is a view taken along a line 15-15 in FIG. 14.

DESCRIPTION OF PREFERRED EMBODIMENTS

A first embodiment of the present invention will now be described with reference to FIGS. 1 to 12.

Figure 1:
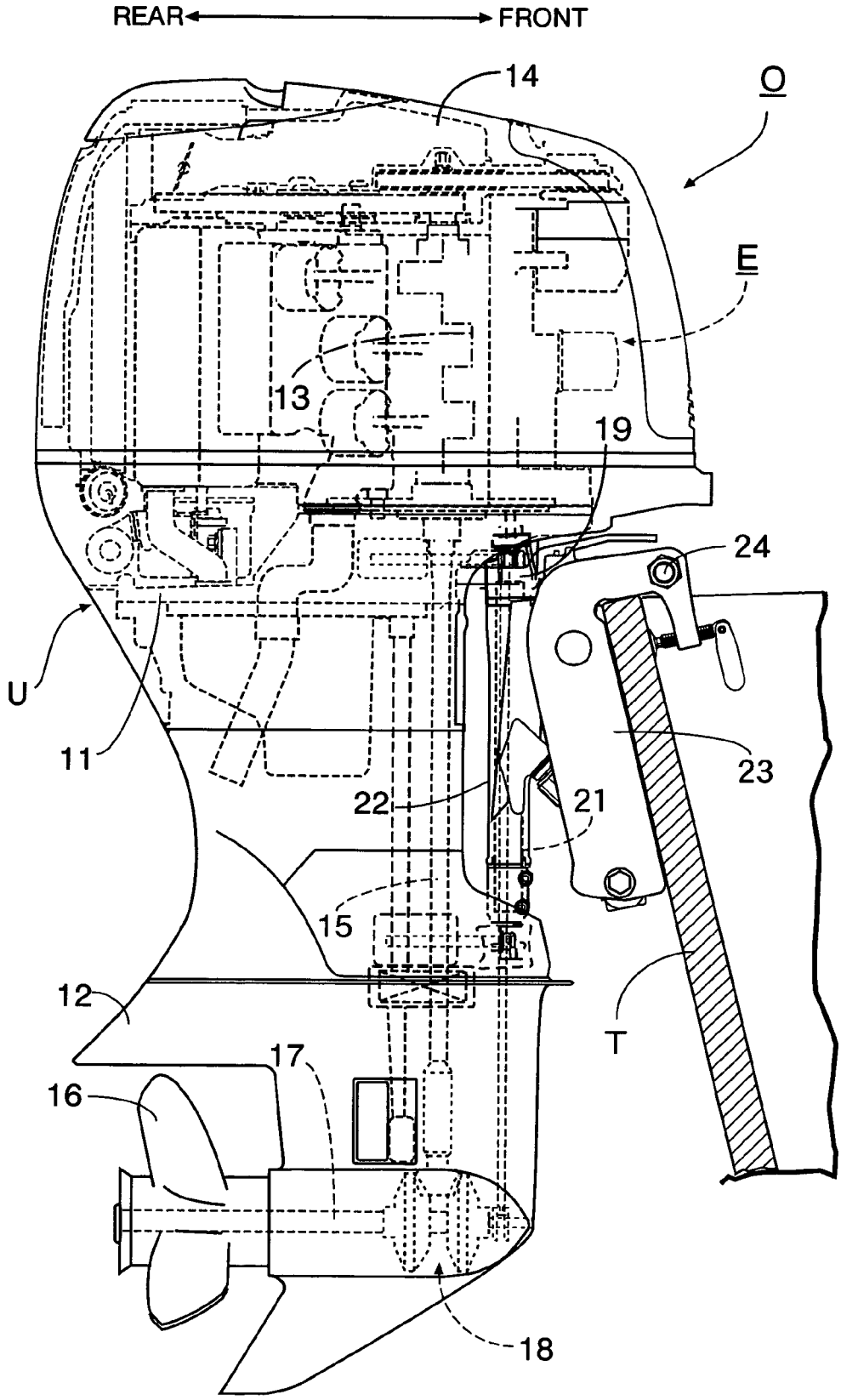

As shown in FIG. 1, a propelling unit U constituting a body portion of an outboard engine system O includes a support case assembly 11 and a gear case 12 coupled to a lower portion of the support case assembly 11. A water-cooled multi-cylinder 4-stroke engine E is mounted at an upper portion of the support case assembly 11 with its crankshaft 13 disposed vertically. An engine cover 14 is openably and closably mounted at an upper end of the support case assembly 11 to cover the engine E. In the present application, the support case assembly 11 is a general term including a mount case which supports a main block of the engine E, an extension case coupled to a lower portion of the mount case, and an undercover which covers peripheries of the mount case and the extension case and receives the engine cover 14 to cover the engine E.

A drive shaft 15 disposed vertically within the support case assembly 11 is connected to a crankshaft 13 of the engine E. A propeller shaft 17 mounting a propeller 16 at its rear end is supported within the gear case 12. A forward and backward movement switchover mechanism 18 connecting the driver shaft 15 to the propeller shaft 17 is housed in the gear case 12. Therefore, a driving force transmitted from the crankshaft 13 to the drive shaft 15 during operation of the engine E is transmitted through the forward and backward movement switchover mechanism 18 to the propeller shaft 17, and the direction of rotation of the propeller shaft 17 is controlled by the forward and backward movement switchover mechanism 18.

A vertically-extending swivel shaft 21 is secured at its opposite ends to an upper arm 19 supporting an upper portion of the support case assembly 11 and a lower arm 20 supporting a lower portion of the support case assembly 11. A swivel case 22 rotatably supporting the swivel shaft 21 is connected through a horizontal tilting shaft 24 to upper portions of a pair of left and right stern brackets 23, 23 which are disposed to sandwich the swivel case 22 from the left and right and clamped to a transom T of a hull. Therefore, the propelling unit U of the outboard engine system O can vertically swing about the tilting shaft 24, and the outboard engine system O is divided into the stern brackets 23, 23 fixed to the hull, and the swivel case 22 and the propelling unit U which can swing with respect to the hull.

Figure 2:
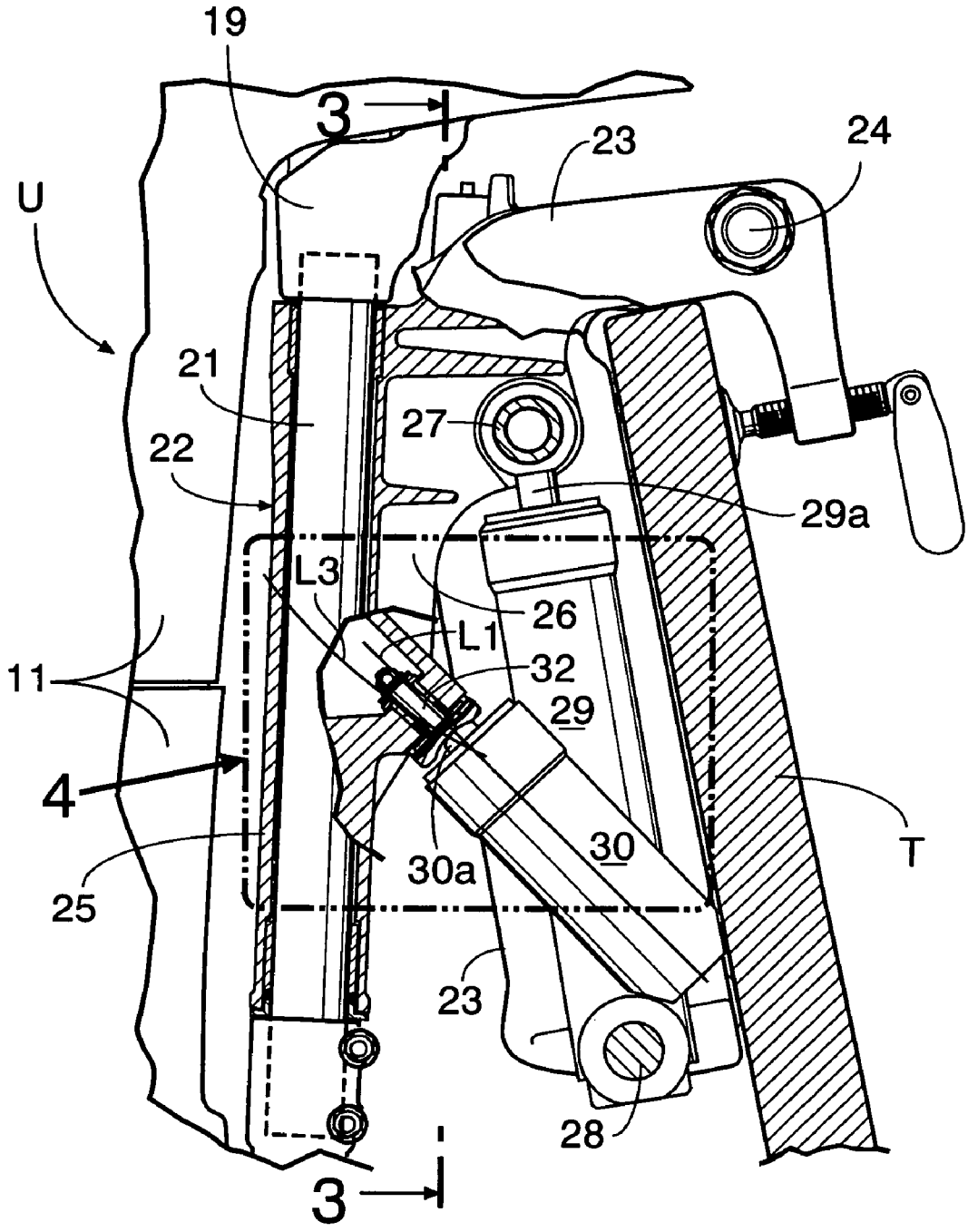
Figure 3:
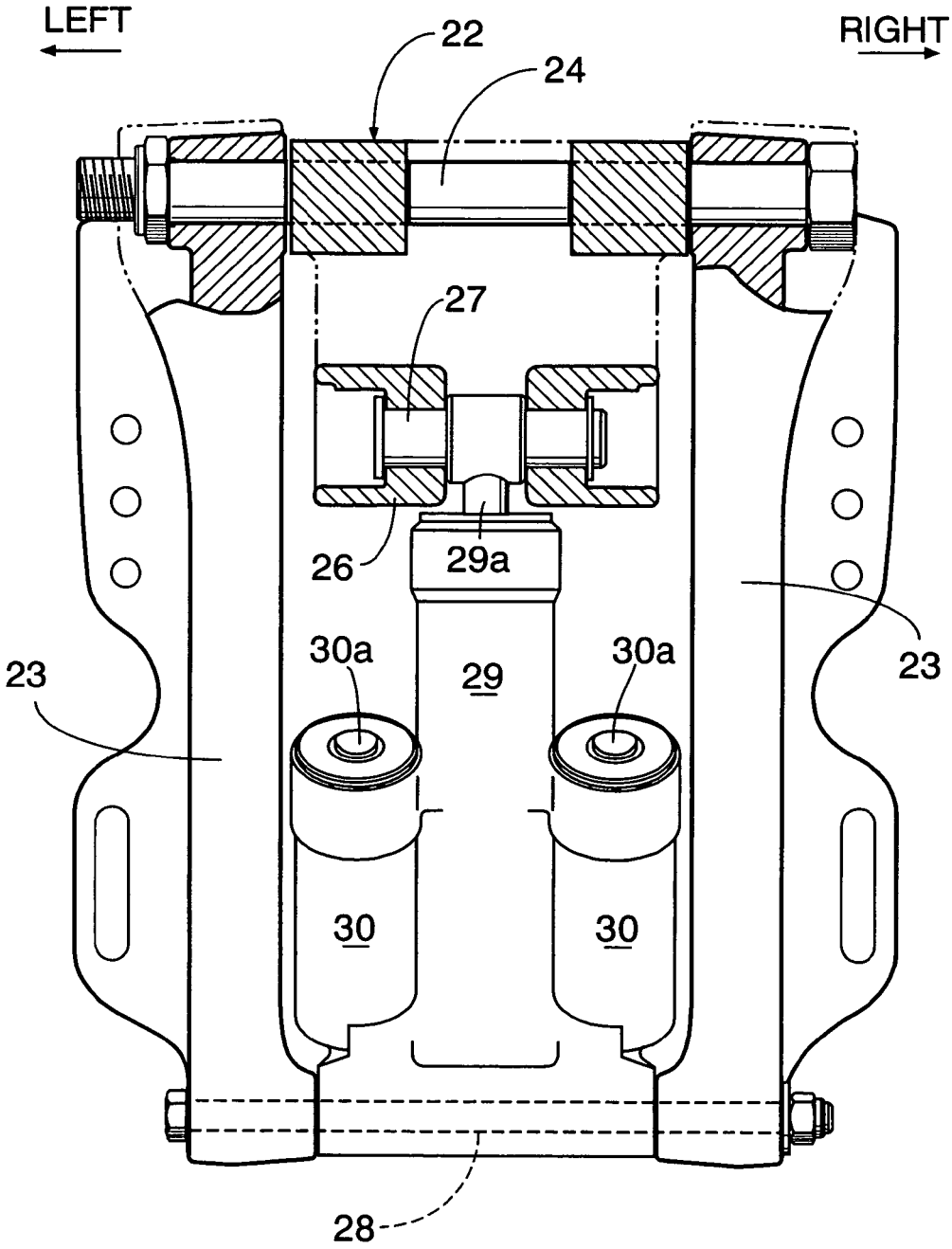

As can be seen from FIGS. 2 and 3, the swivel case 22 includes a cylindrical case section 25 which directly supports the swivel shaft 21, and an arm section 26 extending forwards (toward the hull) from an upper portion of the case section 25 and supported on the tilting shaft 24. A laterally-extending upper pivot 27 is supported at its opposite ends within the arm section 26. A tilting cylinder 29 is pivotally supported at its lower end on a lower pivot 28 laid laterally at lower portions of the pair of left and right stern brackets 23, 23, and a cylinder rod 29*a* protruding from an upper end of the tilting cylinder 29 is pivotally supported on the upper pivot 27.

Figure 4:
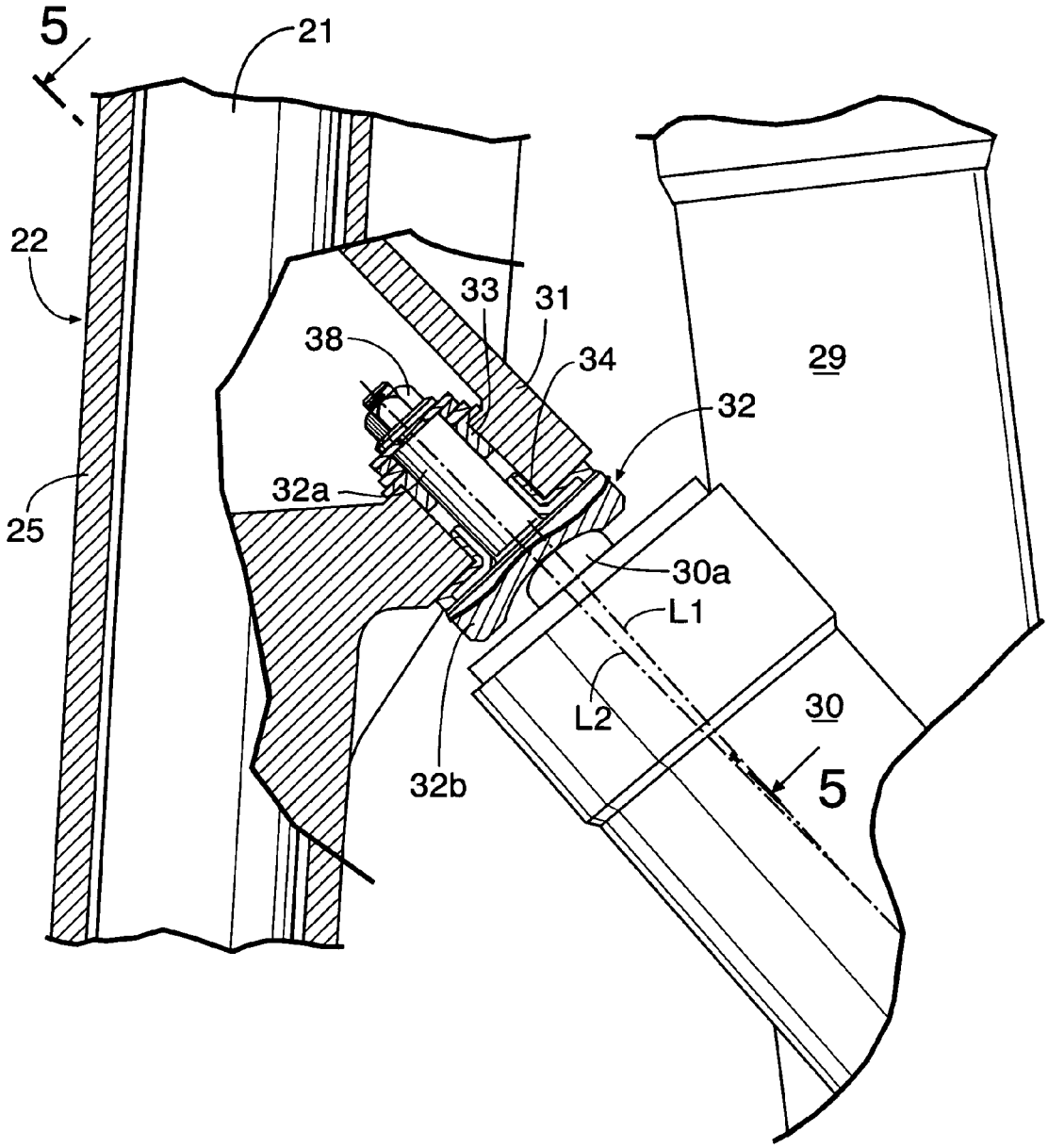
Figure 5:
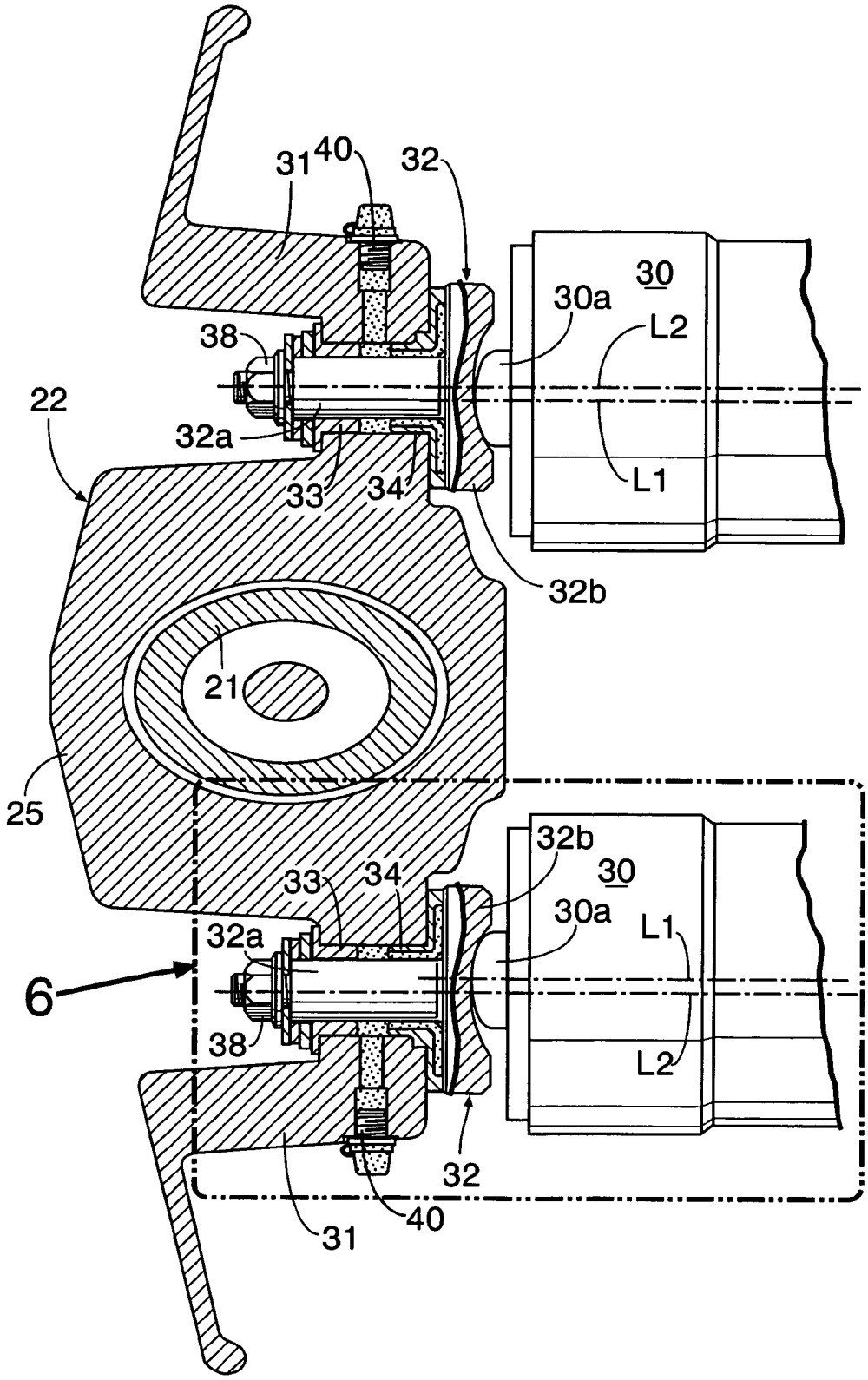

As can be seen from FIGS. 4 and 5, a pair of trim cylinders 30, 30 are integrally formed on laterally opposite sides of the tilting cylinder 29, and trim rods 30*a*, 30*a* protrude from upper ends of the trim cylinders 30, 30 for expansion and contraction. A pair of thrust receiver-supporting portions 31, 31 overhang from laterally opposite sides of the case section 25 of the swivel case 22, and thrust receivers 32 having the same structure are mounted on the thrust receiver-supporting portions 31, 31, respectively.

Figure 6:
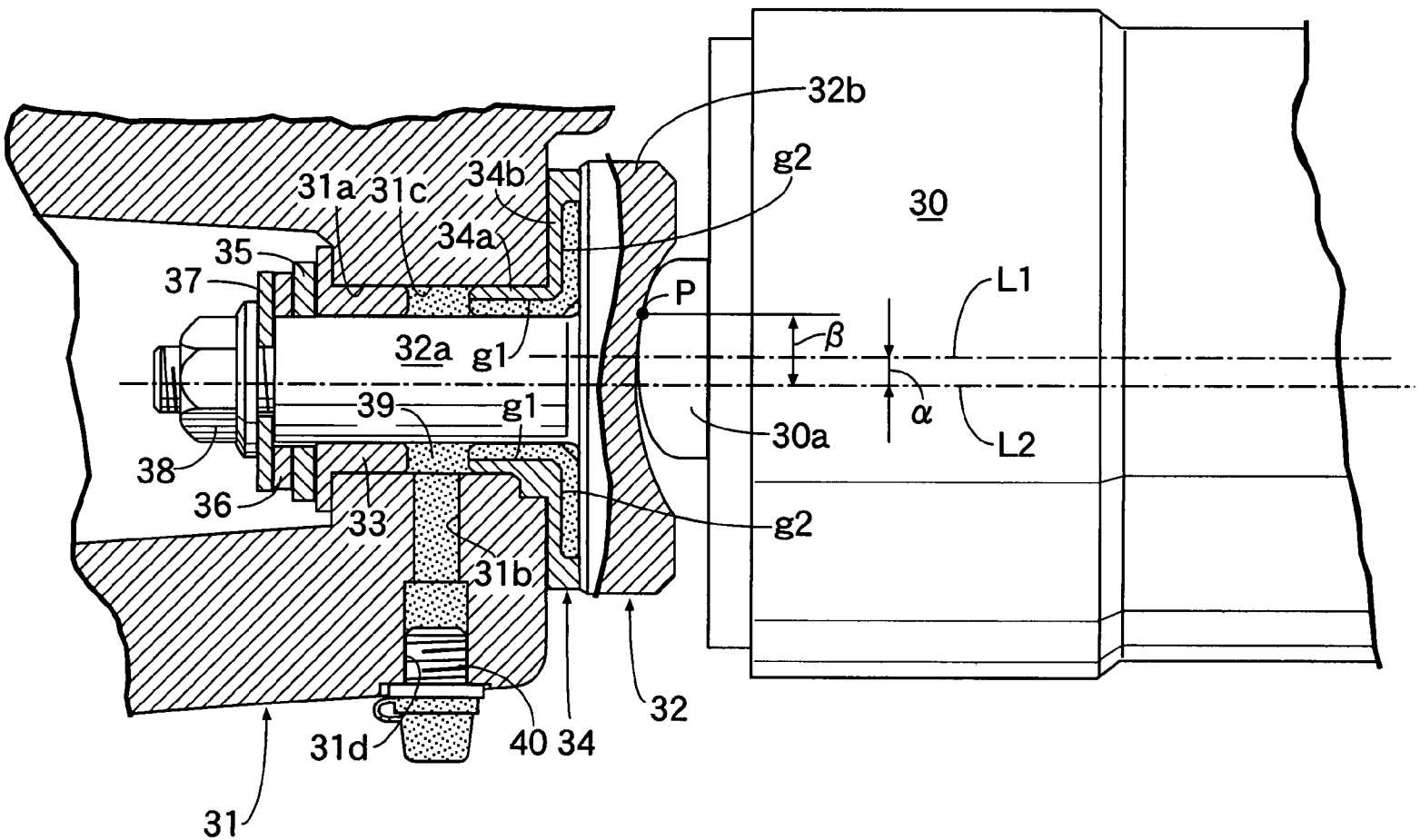
Figure 7:
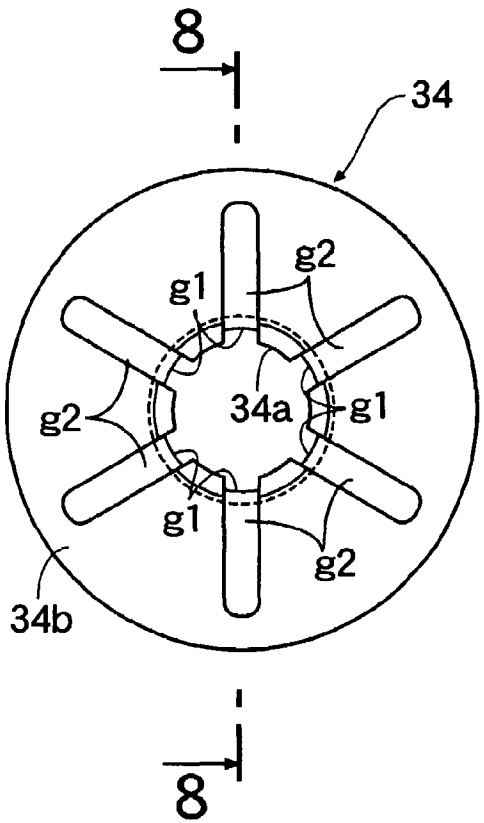
Figure 8:
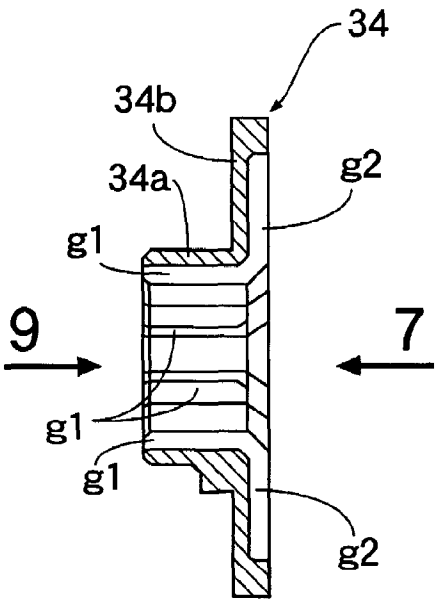
Figure 9:
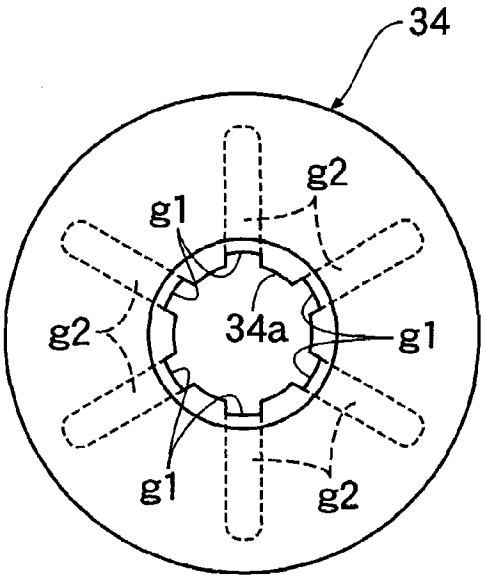

As can be seen from FIG. 6, the thrust receiver 32 is integrally provided with a bar-shaped shaft portion 32*a* and a disk-shaped pressure receiving portion 32*b*. The shaft portion 32*a* is rotatably supported on a first bush 33 and a second bush 34 which are press-fitted into a support bore 31*a* formed so as to pass through the thrust receiver-supporting portion 31. The pressure receiving portion 32*b* is integrally formed at an end of the shaft portion 32*a* on the second bush 34 side, and a nut 38 is threadedly fitted over a tip end of the shaft portion 32*a* protruding from the first bush 33 with three washers 35, 36 and 37 interposed therebetween, whereby the thrust receiver 32 is fixed in a slip-off preventing manner. The pressure receiving portion 32*b* has a surface depressed in a partially spherical shape, and a rounded tip end of the trim rod 30*a* is placed into abutment against the spherical surface. By placing the plurality of washers 35, 36 and 37 one on another, it is possible to prevent a foreign matter from biting into sliding surfaces between the first bushes 33 and the shaft portion 32*a*.

An axis L2 of the shaft portion 32*a* of the thrust receiver 32 is generally parallel to an axis L1 of the trim rod 30*a* of the trim cylinder 30 as viewed from sideways (see FIG. 4), but the axis L2 of the shaft portion 32*a* of the thrust receiver 32 is displaced laterally by a distance $\alpha$ from the axis L1 of the trim rod 30*a* of the trim cylinder 30, as viewed in plane. Therefore, an abutment point P between the trim rod 30*a* and the pressure receiving portion 32*b* of the thrust receiver 32 is displaced laterally by a distance $\beta$ from the axis L2 of the shaft portion 32*a* of the thrust receiver 32 (see FIG. 6).

As can be seen from FIGS. 6 and 7 to 9, the second bush 34 includes a cylindrical portion 34*a* and a flange portion 34*b*. Six oil grooves g1 are formed in the cylindrical portion 34*a* to extend in a direction of the axis L2. Six blind oil grooves g2 are formed radially in an outer surface of the flange portion 34*b* and connected to the six oil grooves g1, respectively. In a state in which the first and second bushes 33 and 34 and the thrust receiver 32 are mounted in the support bore 31*a* in the thrust receiver-supporting portion 31, the oil grooves g1 in the second bush 34 are opposed to an outer peripheral surface of the shaft portion 32*a* of the thrust receiver 32, and the second oil grooves g2 in the second bush 34 are opposed to the back of the pressure receiving portion 32*b* of the thrust receiver 32.

An oil passage 31*b* formed in the thrust receiver-supporting portion 31 communicates with an annular oil reservoir 31*c* which is formed between the first and second bushes 33 and 34 and which communicates with the oil grooves g1 in the second bush 34. Grease 39 is charged from a nipple 40 provided in a grease charging bore 31*d* opening into an outer surface of the thrust receiver-supporting portion 31, through the oil passage 31*b* and the oil reservoir 31*c*, into the oil grooves g1 and g2.

The operation of the first embodiment having the above-described arrangement will be described below.

Figure 10:
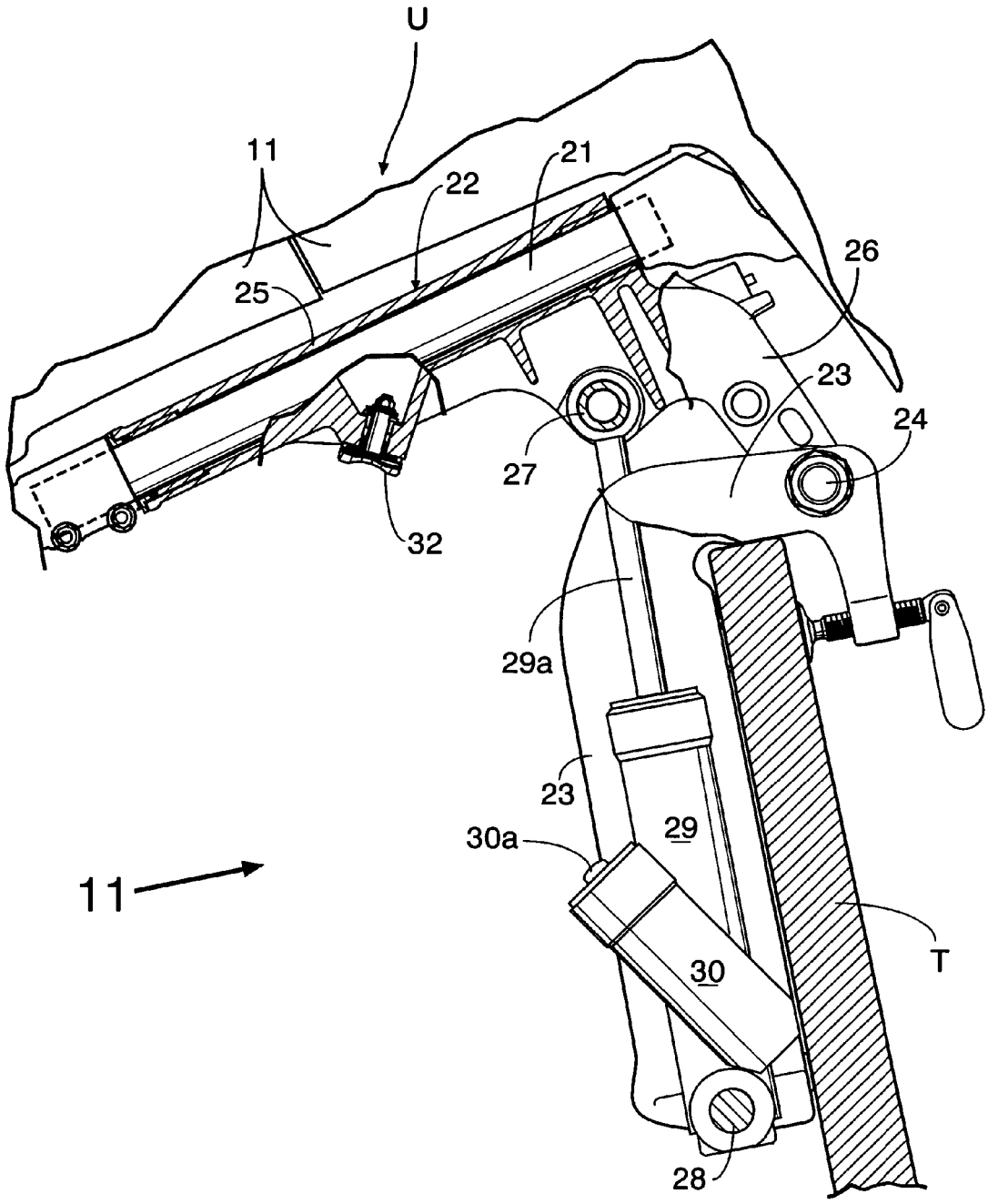
Figure 11:
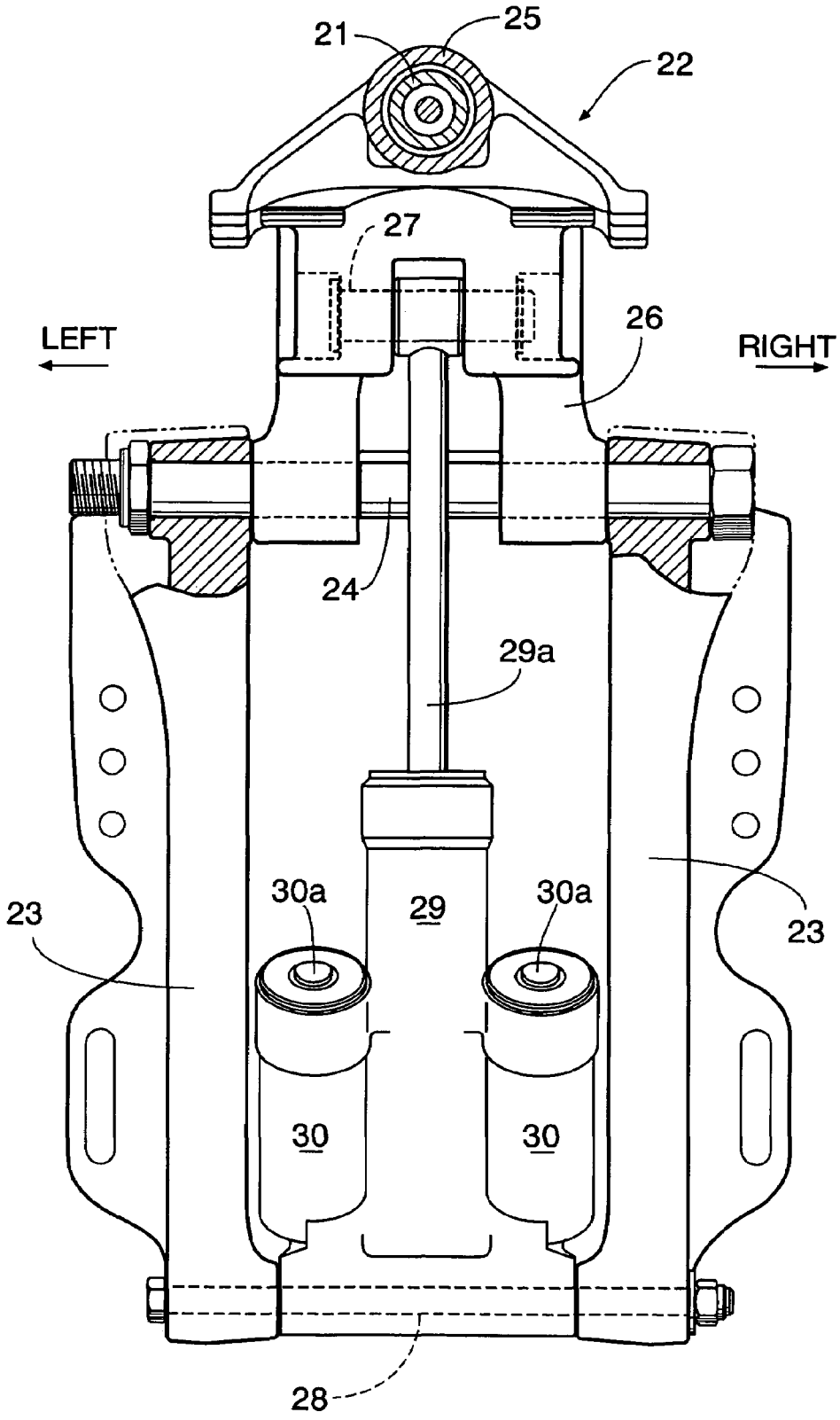

As shown in FIGS. 10 and 11, when the tilting cylinder 29 is driven for expansion to cause the cylinder rod 29*a* to protrude, the arm section 26 of the swivel case 22 is pushed up through the upper pivot 27, whereby the propelling unit U integral with the swivel case 22 is swung about the tilting shaft 24 provided at the upper end of the stern brackets 23, 23 into a tilted-up state. At this time, the trim rods 30*a*, 30*a* of the trim cylinders 30, 30 and the thrust receivers 32, 32 are spaced away from each other into non-abutting states.

A thrust force generated by the propeller 16 during operation of the outboard engine system O causes the propelling unit U to swing in a counterclockwise direction in FIG. 1 about the tilting shaft 24, but this thrust force is transmitted from the pair of thrust receivers 32, 32 mounted on the swivel case 22 through the trimcylinders 30, 30, the tilting cylinder 29 and the stern brackets 23, 23 to the transom T, and an angle of the propelling unit U with respect of the hull is maintained at a predetermined trim angle.

Figure 12:
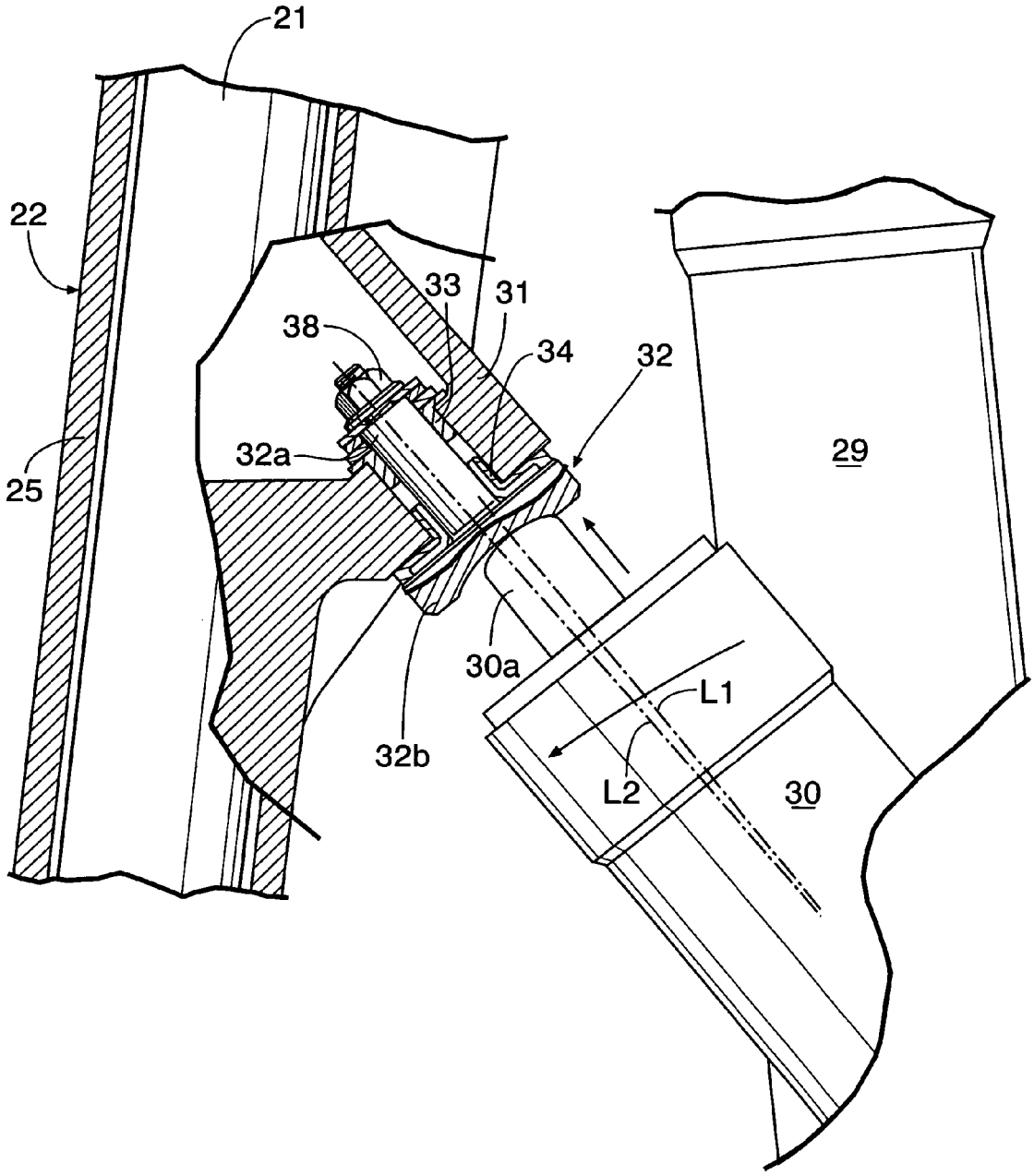

To adjust the trim angle of the propelling unit U with respect of the hull, for example, the trim cylinders 30, 30 are driven for expansion to cause the trim rods 30*a*, 30*a* to protrude, as shown in FIG. 12, the thrust receiver-supporting portions 31, 31 of the swivel case 22 are urged backwards, whereby the propelling unit U is slightly swung about the tilting shaft 24, thereby finely adjusting the thrust shaft of the propeller 16 into a backward ascending inclination. On the other hand, when the trim cylinders 30, 30 are driven for contraction to cause the trim rods 30*a*, 30*a* to retract, the thrust shaft of the propeller 16 is finely adjusted into a backward descending inclination.

In the process of the above-described adjustment of the trim angle, the locus of movement of the thrust receiver 32 draws an arc L3 of a circle about the tilting shaft 24 as shown in FIG. 2, while the locus of movement of the trim rod 30*a* of the trim cylinder 30 is generally in line with the axis L1. When the locus of movement of the thrust receiver 32 and the locus of movement of the trim rod 30*a* are not in line with each other, as described above, there is a possibility that a twisting is generated at the abutment point P (see FIG. 6) between the tip end of the trim rod 30*a* and the pressure receiving portion 32*b* of the thrust receiver 32 to generate an abnormal sound.

In the present embodiment, however, the pressure receiving portion 32*b* of the thrust receiver 32 can be rotated freely about the axis L2 of the shaft portion 32*a*, and the abutment point P is displaced laterally by the distance β from the axis L2 of the shaft portion 32*a* of the thrust receiver 32 (see FIG. 6). Therefore, the twisting can be effectively suppressed to reduce the generation of the abnormal sound by the free rotation of the thrust receiver 32 accompanying the expansion or contraction of the trim rod 30*a*. The thrust receiver 32 is supported on the thrust receiver-supporting portion 31 by utilizing the shaft portion 32*a* which serves as the axis for rotation of the thrust receiver 32, thus contributing to simplification of the structure.

At this time, the tip end of the trim rod 30*a* is moved generally linearly on the axis L1, while the pressure receiving portion 32*b* of the thrust receiver 32 is rotated about the axis L2. Therefore, a slipping is generated between the trim rod 30*a* and the pressure receiving portion 32*b*, but this slipping cannot generate an abnormal sound, because it is extremely slight.

In this way, the generation of the twisting can be suppressed to reduce the abnormal sound by only supporting the thrust receiver 32 for rotation without disposition of a ball on either the trim rod 30*a* or the thrust receiver 32 for bringing both of them into rolling contact with each other. This can simplify the structure to contribute to a reduction in cost. Moreover, it is not necessary to roll a ball on a tip end face of the trim rod 30*a*, and hence the diameter of the trim rod 30*a* can be decreased.

When the thrust force generated by the propelling unit U is transmitted from the thrust receiver 32 to the trim rod 30*a*, the thrust force acting on the pressure receiving portion 32*b* of the thrust receiver 32 is supported on the thrust receiver-supporting portion 31 of the swivel case 32 through the flange portion 34*b* of the second bush 34. At this time, the fat filled in the oil reservoir 31*c* is supplied through the oil grooves g1 in the shaft portion 34*a* of the second bush 34 into the oil grooves g2 in the flange portion 34*b*, and hence the thrust receiver 32 can be rotated even under a large thrust force, thereby effectively suppressing the generation of an abnormal sound. Of course, the fat supplied to the oil grooves g1 lubricates sliding surfaces between the shaft portion 32*a* of the thrust receiver 32 and the cylindrical portion 34*a* of the second bush 34.

The bush section is bisected into the first and second bushes 33 and 34, and the oil reservoir 31*c* is formed between the first and second bushes 33 and 34. Therefore, it is possible not only to easily form the oil reservoir 31*c*, but also to reliably supply the fat to both the first and second bushes 33 and 34 over a long period by continuously supplying the fat from the oil reservoir 31*c* to the sliding surfaces. Moreover, the oil reservoir 31*c* communicates with the grease charging bore 31*d* in the surface of the thrust receiver-supporting portion 31 through the oil passage 31*b*, and hence the supply of the fat can be carried out without separating the thrust receiver 32 from the thrust receiver-supporting portion 31, leading to an enhanced maintenance property.

Figure 13:
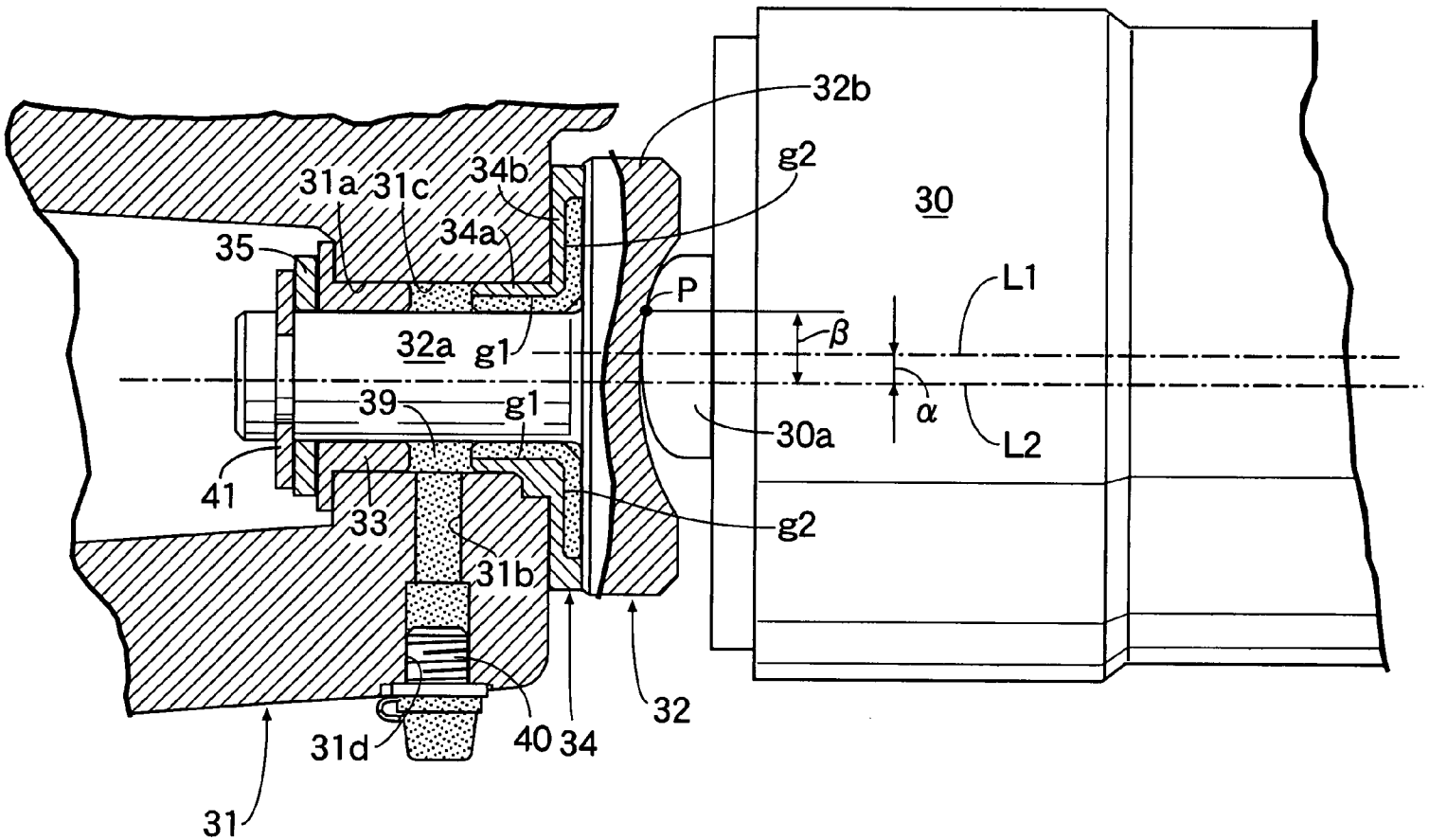
FIG. 13 is a view similar to FIG. 3, but according to a second embodiment of the present invention.

A second embodiment of the present invention will now be described with reference to FIG. 13.

In the first embodiment, the shaft portion 32*a* of the thrust receiver 32 is fixed in a slip-off preventing manner by the nut 38, but in the second embodiment, a shaft portion 32*a* of a thrust receiver 32 is fixed in the slip-off preventing manner by a cisclip 41 in place of the nut 38. According to the second embodiment, the mounting and removing of the thrust receiver 32 are further facilitated, leading to an enhanced maintenance property.

Figure 14:
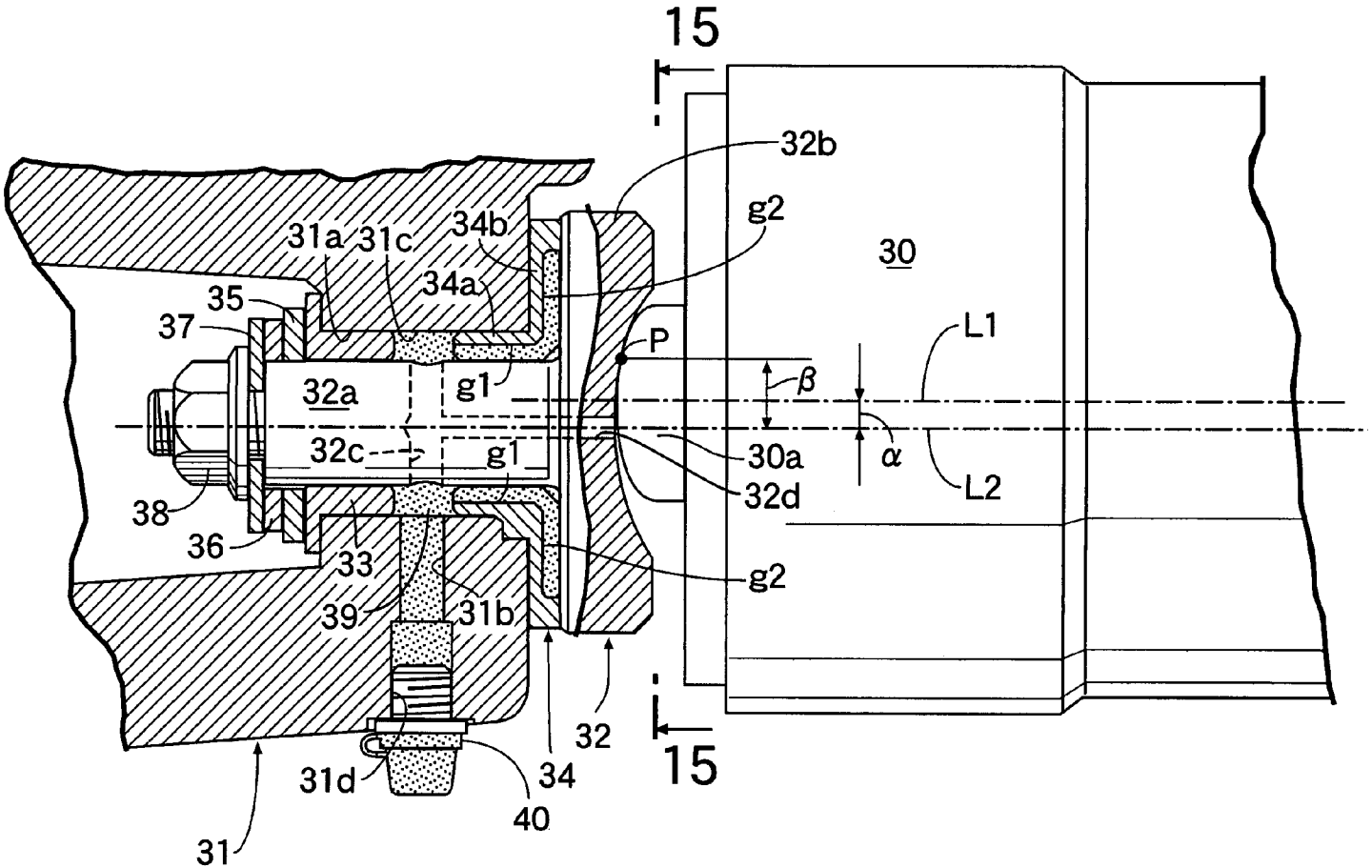
Figure 15:
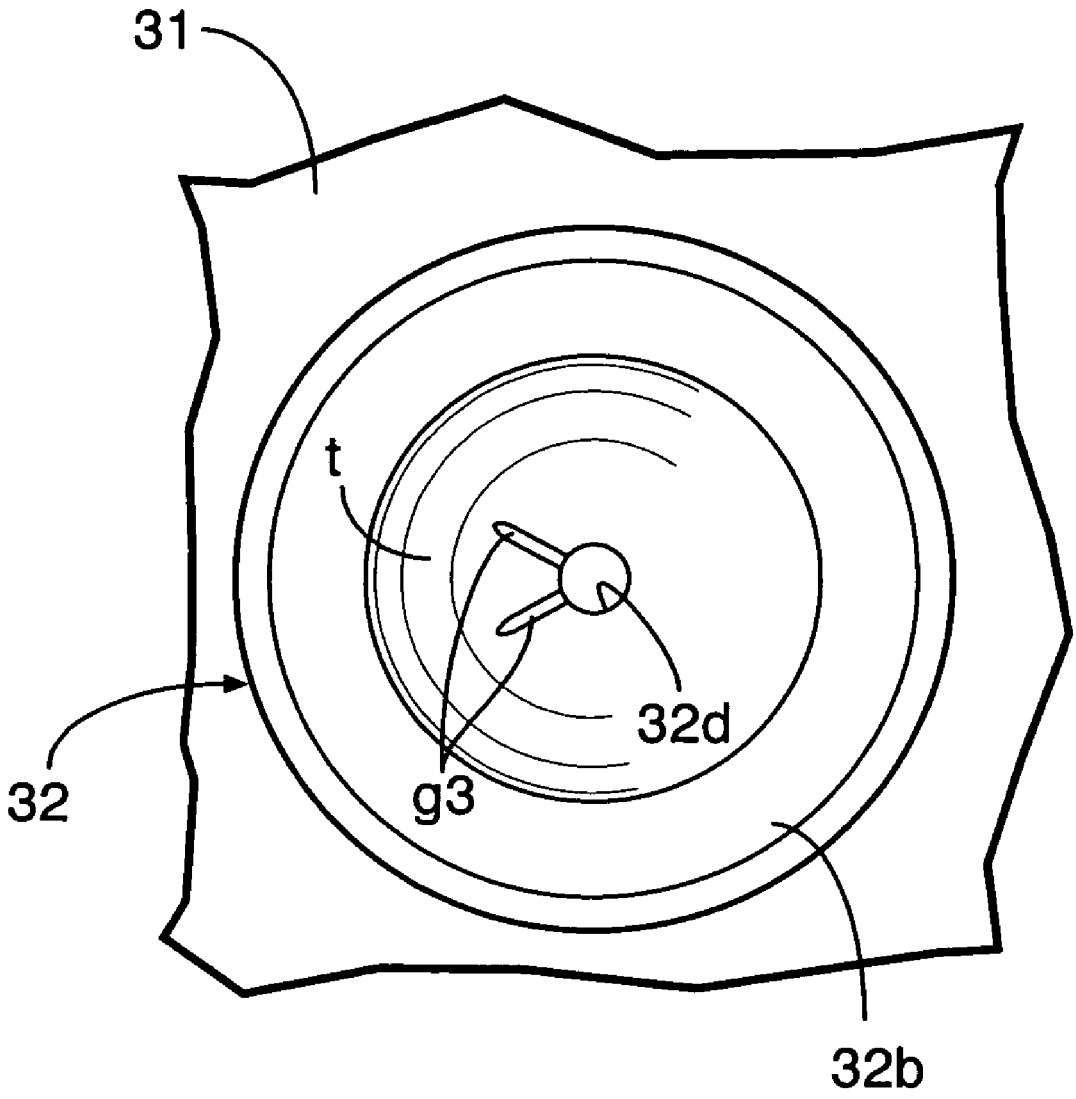

A third embodiment of the present invention will now be described with reference to FIGS. 14 and 15.

In the first embodiment, the abutment point P between he pressure receiving portion 32*b* of the thrust receiver 32 and the trim rod 30*a* is not lubricated, but in the third embodiment, the abutment point P is lubricated by fat from an oil reservoir 31*c*. More specifically, oil passages 32*c* and 32*d* are formed within a shaft portion 32*a* of a thrust receiver 32 to provide a communication between surfaces of the oil reservoir 31*a* and the pressure receiving portion 32*b*, and a plurality of (two in the embodiment) oil grooves g3 are formed in the surface of the pressure receiving portion 32*b* to extend radially from an outlet of the oil passage 32*d*. Thus, the abutment point P between the pressure receiving portion 32*b* of the thrust receiver 32 and the trim rod 30*a* can be lubricated to further reduce an abnormal sound during adjustment of the trim angle. The oil grooves g3 as non-contact portions are out of a range (a contact portion t) of a locus of the abutment point P of the trim rod 30*a*, and fat can be supplied to the contact point P existing in the contact portion t, while preventing the trim rod 30*a* from contacting the oil grooves g3 and obstructing the smooth movement.

The oil grooves g3 may be provided in all radial directions in correspondence to the rotation of the thrust receiver 32.

Figure 16:
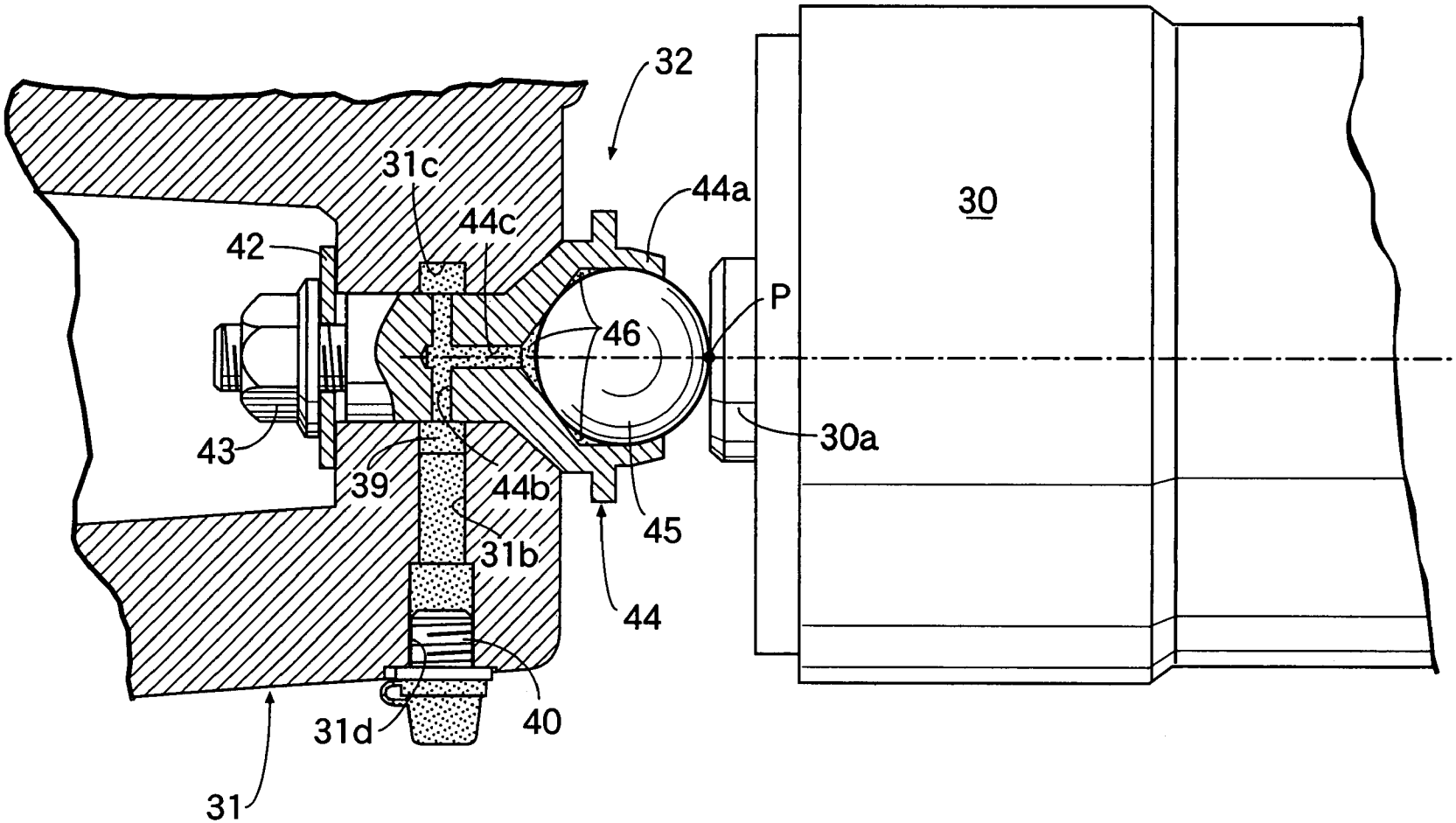
FIG. 16 is a view similar to FIG. 6, but according to a fourth embodiment of the present invention.

A fourth embodiment of the present invention will now be described with reference to FIG. 16.

The fourth embodiment is different from the first embodiment (see FIG. 6) with respect to the structure of a thrust receiver 32. The thrust receiver 32 in the fourth embodiment includes a ball holder 44 which is fitted into a support bore 31*c* in a thrust receiver-supporting portion 31 and fixed by a washer 42 and a nut 43. A ball-retaining portion 44*a* is formed at a tip end of the ball holder 44 protruding from the thrust receiver-supporting portion 31, and a ball 45 is rotatably supported within the ball-retaining portion 44*a* to abut against a flat tip end face of a trim rod 30*a* for rolling. An oil passage 31*b* and an oil reservoir 31*c* are formed in the thrust receiver-supporting portion 31 to lead to a nipple 40. The oil reservoir 31*c* communicates with a space 46 formed between the ball-retaining portion 44*a* and the ball 45 through oil passages 44*b* and 44*c* formed within the ball holder 44.

Thus, when the trim rod 30*a* of the trim cylinder 30 is expanded or contracted to adjust the trim angle of the propelling unit U, the ball 45 is rolled on the tip end face of the trim rod 30*a*, thereby suppressing the generation of an abnormal sound. During this time, grease 39 supplied from a grease charging bore 31*d* fills the oil passage 31*b*, the oil reservoir 31*c*, the oil passages 44*b* and 44*c* and the space 46, thereby enabling the smooth rotation of the ball 45 relative to the ball-retaining portion 44*a*.

According also to the fourth embodiment, sliding portions between the ball-retaining portion 44*a* and the ball 45 can be lubricated over a long period by the grease 39 stored in the oil passage 31*b*, the oil reservoir 31*c*, the oil passages 44*b* and 44*c* and the space 46, and moreover the grease 39 can be easily supplied from the outside using the nipple 40.

Although the embodiments of the present invention have been described in detail, various modifications in design may be made without departing from the subject matter of the invention.

For example, in each of the embodiments, the trim cylinders 30, 30 are mounted on the stern brackets 23, 23, and the thrust receivers 32, 32 are mounted on the propelling unit U, but the positional relationship between them can be reversed, i.e.,the trim cylinders may be mounted on the propelling unit U, and the thrust receivers 32, 32 may be mounted on the stern brackets 23, 23.

Also, in the embodiments, the fat for lubricating the abutment point P between the pressure-receiving portion 32*b* of the thrust receiver 32 and the trim rod 30*a* is supplied from the side of the thrust receiver 32, but may be supplied from the side of the trim rod 30*a*.

What is claimed is:

1. An outboard engine system comprising:

a system body having a propeller shaft;

a mounting device for mounting the system body to a hull for tilting movement;

a trim device having an expandable and contractable trim rod mounted on one of the system body and the mounting device; and a thrust receiver mounted on the other of the system body and the mounting device to support a thrust force of the system body transmitted through the trim rod of the trim device, wherein the thrust receiver includes:

a shaft portion extending through a lubricant reservoir and supported for rotation about an axis generally parallel to an axis of the trim rod; and a pressure-receiving portion provided at one end of the shaft portion to abut against a tip end of the trim rod; and wherein an abutment point between the tip end of the trim rod and the pressure-receiving portion of the thrust receiver is displaced from the axis of the shaft portion in a lateral direction of the system body.

2. An outboard engine system according to claim 1, wherein the shaft portion of the thrust receiver is mounted to a thrust receiver-supporting portion.

3. An outboard engine system according to claim 1 or 2, further comprising a fat-supplying means for supplying fat to a surface of the pressure-receiving portion of the thrust receiver.

* * * * *